US010104743B2

(12) United States Patent
Van Liempd et al.

(10) Patent No.: US 10,104,743 B2
(45) Date of Patent: Oct. 16, 2018

(54) COLOR SELECTION INPUT DEVICE AND METHOD

(75) Inventors: Marieke Johanna Catharina Van Liempd, Eindhoven (NL); Abraham Franciscus Maria Hendriks, Maastricht (NL); Judith Maria Trippelvizt, Haarlem (NL); Lotte Van Lier, Delft (NL); Nina Roelande Horstra, Delft (NL); Willemijn Elise Damai Prins, Delft (NL); Lucius Theodorus Vinkenvleugel, Veldhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 2334 days.

(21) Appl. No.: 12/863,201

(22) PCT Filed: Jan. 21, 2009

(86) PCT No.: PCT/IB2009/050211

§ 371 (c)(1), (2), (4) Date: Jul. 16, 2010

(87) PCT Pub. No.: WO2009/093179

PCT Pub. Date: Jul. 30, 2009

(65) Prior Publication Data

US 2010/0308755 A1 Dec. 9, 2010

(30) Foreign Application Priority Data

Jan. 24, 2008 (EP) ..... 08100885

(51) Int. Cl.
*G09G 5/02* (2006.01)
*H05B 33/08* (2006.01)

(52) U.S. Cl.
CPC ..... *H05B 33/0863* (2013.01)

(58) Field of Classification Search
CPC .. G09G 3/00; G09G 5/06; G09G 5/02; G09G 2320/0666; G09G 3/2003; G09G 2340/10;
(Continued)

(56) References Cited

U.S. PATENT DOCUMENTS 1,731,772 A * 10/1929 Greenewalt ..... 315/295
2,866,277 A * 12/1958 Wise ..... 434/98
(Continued)

FOREIGN PATENT DOCUMENTS

WO 03015067 A1 2/2003
WO 2006134529 A2 12/2006
(Continued)

OTHER PUBLICATIONS

Grouchnikov, K.: "Pushing Pixels"; Blog Regarding User Interfaces, Imaging and Related Topics, Downloaded From http://www.pushing-pixels.org/?p=132, on Oct. 3, 2007, 5 Page Document.

*Primary Examiner* — Minh D A

(57) ABSTRACT

The invention relates to color selection input, for example by means of color selection wheels or pads, particularly for a lighting system. An embodiment of the invention provides a color selection input device (10) comprising hue selection means (12) representing selectable colors in terms of hue gradation along a direction thereof, saturation selection means (14) representing a selectable saturation gradation along a direction thereof, wherein the hue selection means (12) and the saturation selection means (14) are arranged such that they comprise an overlapping region (16) and the saturation selection means (14) are transparent and shaded from fully transparent to fully white for visualizing a hue and saturation selection in the overlapping region (16), and means (18) for detecting the positions of the hue selection means (12) and the saturation selection means (14) and (Continued)

generating a color selection signal (19) depending on the detected positions. This may make navigating through the hue and saturation color space more convenient and intuitive for users.

11 Claims, 4 Drawing Sheets

(58) Field of Classification Search
CPC ..... G09G 5/393; G09G 2360/144; G09G 2320/0626; G09G 3/20; G09G 3/3406; G09G 3/3648; H05B 33/0863; G06F 3/016; G06F 3/011; G06F 3/038; G06F 3/03543; G06F 3/0338; G06F 3/0488; G06F 3/04883; G06F 3/044; G06F 3/04886; G06F 3/045; G06T 11/001; G06T 15/503; G06T 11/60
USPC ..... 362/85
See application file for complete search history.

(56) References Cited

U.S. PATENT DOCUMENTS 3,088,227 A * 5/1963 Tudor ..... 434/102
3,816,739 A * 6/1974 Stolov ..... 362/231
4,310,314 A * 1/1982 Worn et al. ..... 434/101
4,894,760 A * 1/1990 Callahan ..... 362/293
4,980,806 A * 12/1990 Taylor et al. ..... 362/85
5,317,678 A * 5/1994 Okawara et al. ..... 345/426
5,371,844 A * 12/1994 Andrew et al. ..... 715/747
5,515,254 A * 5/1996 Smith et al. ..... 362/293
5,825,548 A * 10/1998 Bornhorst et al. ..... 359/578
6,456,293 B1 * 9/2002 Grandy ..... 345/591
7,180,524 B1 * 2/2007 Axelrod ..... 345/593
7,215,813 B2 5/2007 Graves et al.
7,242,409 B2 7/2007 Cain
8,730,256 B2 * 5/2014 Vinkenvleugel et al. .... 345/590
2002/0063801 A1 * 5/2002 Richardson ..... 348/589
2003/0103057 A1 * 6/2003 Graves et al. ..... 345/589
2003/0176768 A1 * 9/2003 Gono et al. ..... 600/109
2005/0024734 A1 * 2/2005 Richards et al. ..... 359/634
2005/0050251 A1 * 3/2005 Niida ..... 710/72
2005/0110768 A1 * 5/2005 Marriott et al. ..... 345/173
2005/0212980 A1 * 9/2005 Miyazaki ..... 348/744
2006/0055630 A1 * 3/2006 Cheang et al. ..... 345/44
2006/0211494 A1 * 9/2006 Helfer ..... 463/30
2006/0290710 A1 12/2006 Zwanenburg
2007/0165317 A1 * 7/2007 Thollot et al. ..... 359/892
2007/0230159 A1 * 10/2007 Cortenraad et al. ..... 362/85
2007/0279534 A1 * 12/2007 Doser ..... 348/743
2008/0062192 A1 * 3/2008 Voliter et al. ..... 345/591
2008/0259590 A1 * 10/2008 De Goederen -Oei ..... 362/85
2009/0115431 A1 * 5/2009 Philipp ..... 324/686
2009/0128059 A1 * 5/2009 Joosen et al. ..... 315/312
2009/0135021 A1 * 5/2009 Joosen ..... 340/825.22
2009/0153352 A1 * 6/2009 Julio ..... 340/825.22
2009/0174568 A1 * 7/2009 Diederiks et al. ..... 340/825
2009/0200967 A1 * 8/2009 Bergman et al. ..... 315/363
2010/0171444 A1 * 7/2010 Bennette ..... 315/312

FOREIGN PATENT DOCUMENTS

WO 2007072294 A1 6/2007
WO WO2007072294 * 6/2007 ..... G06F 3/048
WO WO2007098137 * 8/2007 ..... G01N 21/35

* cited by examiner

COLOR SELECTION INPUT DEVICE AND METHOD

FIELD OF THE INVENTION

The invention relates to color selection input, for example by means of color selection wheels or pads, particularly for a lighting system.

BACKGROUND OF THE INVENTION

Modern lighting systems allow creating certain lighting atmospheres for example by applying different kinds of lighting, such as colored lighting. An example of such a lighting system is the new LivingColors™ lamp of the applicant. This lamp allows a user to comfortably create a desired colored lighting atmosphere with a remote control unit as a user interface, which enables a user to control the light and to navigate in the hue/saturation/brightness color space with different user input means. For adjusting the hue, a wheel is provided. The saturation and brightness are controlled with separate buttons for increasing and decreasing the saturation and brightness, respectively.

WO 2007/072294 A1 discloses a user interface device for controlling a light source, which includes a central button configured to change color of light emitted from the light source when actuated by circumnavigating a color wheel, a saturation button configured to change saturation of the light when actuated, and a hue button configured to adjust hue of said light when actuated. The central, saturation and hue buttons may be discrete buttons or integrated into a single button. The user interface device further includes a brightness button located at a spaced distance from the central button and is configured to change intensity of the light when actuated. This user interface device allows a user to navigate the hue/saturation/brightness color space by activating the respective buttons.

However, user tests with color input devices have shown that many users have difficulties to navigate to the hue/saturation color space and to make distinction between the concepts "saturation" and "dimming".

SUMMARY OF THE INVENTION

It is an object of the present invention to provide an improved color selection input device and method.

The object is solved by the independent claims. Further embodiments are shown by the dependent claims.

A basic idea of the invention is to visualize the user intended color setting on a color selection input device in order to make it more comfortable for users to navigate in the hue/saturation color space of for example a lighting system. This may be accomplished according to the invention by means of hue input means and saturation input means, which are arranged such that these means partially overlap and the overlapping area indicates the chosen color setting in the hue/saturation color space. This enables users to intuitively navigate in the hue/saturation color space and comfortably select a desired color. Moreover, since the invention is a kind of WYSIWYG (What You See Is What You Get) input method, a user can easily understand how to use a color input device according to the invention and how to make colors with the parameters associated with the hue and saturation input means. The invention may be applied to a lighting or visualization system. A lighting system may be for example an ambience lighting system such as the new LivingColors™ lamp of the applicant. A visualization system may be for example a display screen such as a color TV set, computer monitor, a digital photo frame for displaying pictures or a color printer or copier or photo printer for printing color pictures or color photos. In principle, the invention may be applied to any system which generates colors in any way.

An embodiment of the invention provides a color selection input device comprising

- hue selection means representing selectable colors in terms of hue gradation along a direction thereof,
- saturation selection means representing a selectable saturation gradation along a direction thereof, wherein
- the hue selection means and the saturation selection means are arranged such that they comprise an overlapping region and the saturation selection means are transparent and shaded from fully transparent to fully white for visualizing a hue and saturation selection in the overlapping region, and
- means for detecting the positions of the hue selection means and the saturation selection means and generating a color selection signal depending on the detected positions.

By such an arrangement of the hue and saturation selection means, it is possible to visualize a user selected combination of hue and saturation, which makes navigating through the hue and saturation color space more convenient and intuitive for a user than a color input possibility with discrete buttons for hue and saturation selection. The overlapping region forms a kind of result window for visualizing the hue/saturation combination selected by a user. Since the saturation selection means are transparent and shaded, in the overlapping region the saturation of a selected hue may be easily selected with the saturation selection means and seen in the overlapping region. In an embodiment of the color selection input device as remote control unit, the means for position detection and signal generation may be for example implemented by an electronic circuitry, wherein the generated color selection signal may be transmitted wireless for example by a radio link or via an infrared transmission.

In an embodiment of the invention, the input device may further comprise brightness selection means representing a selectable brightness gradation along a direction thereof, wherein the brightness selection means are arranged such that they comprise together with the hue selection means and the saturation selection means the overlapping region and the brightness selection means are transparent and shaded from fully transparent to fully black for visualizing a hue, saturation and brightness selection in the overlapping region.

According to a further embodiment of the invention, the hue selection means, the saturation selection means and/or the brightness selection means may be implemented by means of a selection wheel. A selection wheel may be rotated in order to select a hue and saturation, and the result of the combination is visualized in the overlapping region. The selection wheel for the saturation is typically transparent and arranged beyond the selection wheel for the hue gradation. Also, the brightness selection wheel may be implemented as transparent wheel and arranged beyond the other selection wheels.

In yet further embodiment of the invention, the saturation selection means or the brightness selection means may be implemented by means of a selection bar. A selection bar may be moved in a straight direction for selecting a desired brightness level.

According to a further embodiment of the invention, the hue selection means and the saturation selection means may be implemented by means of a selection wheel and both selection wheels may be arranged side by side with an overlapping area comprising the overlapping region. This may require some place for example in a remote control unit, but may make navigation very comfortable for a user due to the large selection area available for the user.

According to a further embodiment of the invention, the brightness selection means may be implemented by means of a selection wheel, which is arranged such that it partly covers the overlapping region. This may make navigation very intuitive since a user may see a selected hue, saturation and brightness combination directly in the overlapping region.

The hue selection means and the saturation selection means may be implemented in a further embodiment of the invention by means of a selection wheel and one of the selection wheels may have a smaller diameter than the other selection wheel and be arranged on the other selection wheel with an overlapping area comprising the overlapping region. This requires less space on a remote control unit than an arrangement of the wheels side by side.

In a further embodiment of the invention, the hue selection means, the saturation selection means and/or the brightness selection means may be implemented by mechanical rotation wheels. These wheels may further comprise position detectors, which may be electronically read by for example an electronic circuitry for detecting the selected positions of the wheels and generating a respective color selection signal.

The saturation selection means and/or the brightness selection means may be also implemented in an embodiment of the invention by mechanical selection bars. A mechanical selection bar may be for example a kind of potentiometer, wherein the position of the bar may then be electronically detected by analyzing the resistance of the potentiometer.

Also, in an embodiment of the invention, the hue selection means, the saturation selection means and/or the brightness selection means may be applied on a touch screen display. Thus, the wheels may be electronically displayed on the touch screen display and rotated virtually.

A further embodiment of the invention relates to a color selection input method comprising

- providing hue selection means representing selectable colors in terms of hue gradation along a direction thereof,
- providing saturation selection means representing a selectable saturation gradation along a direction thereof, wherein
- arranging the hue selection means and the saturation selection means such that they comprise an overlapping region and the saturation selection means are transparent and shaded from fully transparent to fully white for visualizing a hue and saturation selection in the overlapping region, and
- detecting the positions of the hue selection means and the saturation selection means and generating a color selection signal depending on the detected positions.

This method may be for example applied to a touch screen display and may allow a user to intuitively navigate the hue and saturation color space by touching on the display for selecting a represented hue and saturation color combination, while the user may see the selected combination in the overlapping area on the display.

According to a further embodiment of the invention, a computer program is provided, wherein the computer program may be enabled to carry out the method according to the invention when executed by a computer. The computer program allows implementing the invention for example in a Personal Computer (PC), a Personal Digital Assistant (PDA) or a Cell Phone which may be used for controlling a lighting system.

According to an embodiment of the invention, a record carrier such as a CD-ROM, DVD, memory card, floppy disk or similar storage medium may be provided for storing a computer program according to the invention.

These and other aspects of the invention will be apparent from and elucidated with reference to the embodiment(s) described hereinafter.

BRIEF DESCRIPTION OF THE DRAWINGS

The invention will be described in more detail hereinafter with reference to exemplary embodiments. However, the invention is not limited to these exemplary embodiments.

DETAILED DESCRIPTION OF EMBODIMENTS

Figure 1:
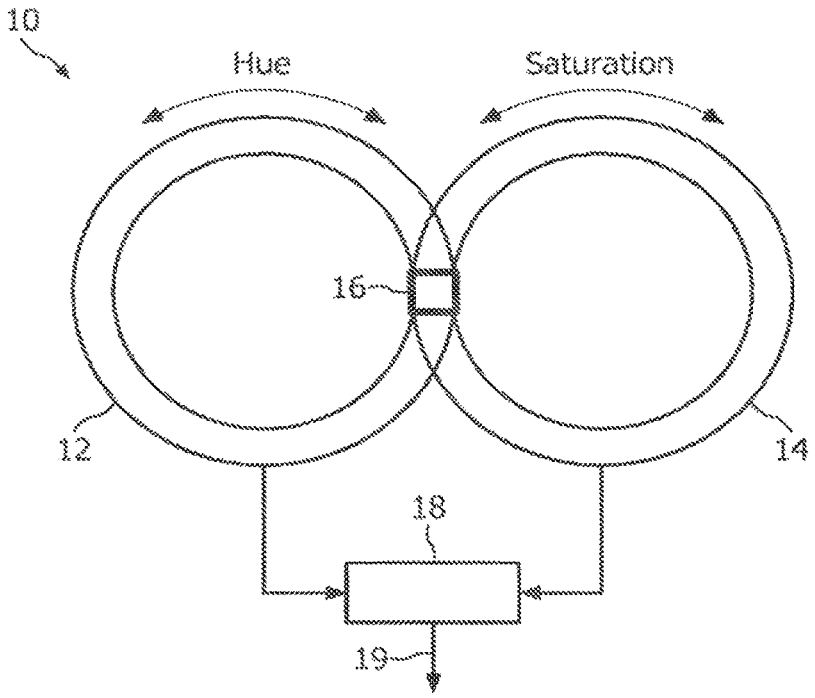
FIG. 1 shows a first embodiment of a color input device with a hue selection wheel and a saturation selection wheel according to the invention.

In the following description, the invention is described by means of a color wheel or circle which is an often used device to input a color selection into a modern lighting system. However, it should be noted that the invention is not limited to color wheels or circles and to lighting systems and may be also implemented by other input devices such as a color sliding control, or a touch pad or computer program visually representing the "color space", i.e. the available colors in a two dimensional representation, and used for color selection for example for a TV set or a Computer display. Furthermore, (functional) similar or identical elements in the drawings may be denoted with the same reference numerals in the following description.

Figure 6:
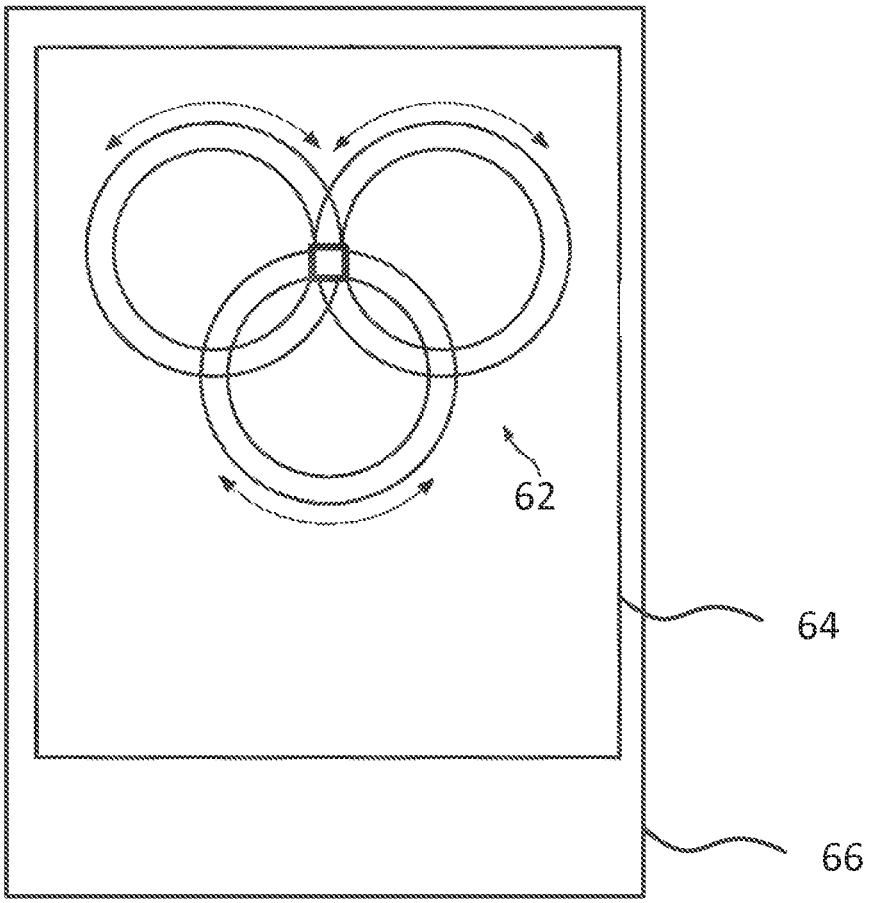
FIG. 6 shows an embodiment of a lighting system control PC with a color input device with a hue selection wheel, a saturation selection wheel, and a brightness selection wheel according, to the invention.

Modern lighting systems allow not only controlling the lighting intensity, but also. the lighting color in order to create a pleasant atmosphere, In order to navigate and set colors of a light source, a so-called color circle or color wheel, respectively, may be used. The color circle represents selectable colors in terms of hue gradation along a circumferential direction thereof. Also, the selectable colors may be visually displayed on the color circle instead of for example with a textual representation. The color circle thus forms a kind of comfortable color selection area for a user. A user can select a certain color by either mechanically rotating the color circle, or by touching the preferred hue on the color circle 62 when the color circle or wheel is implemented by a touch sensitive color input device such as a touch screen display 64, as illustrated in FIG. 6. The selection hue may be transmitted from a color selection input device comprising the color circle to a lighting system, which then sets the desired color by controlling the light sources of the lighting system. The color circle may be implemented for example in a light switch, a lighting system control board, a lighting system control PC 66, as illustrated in FIG. 6, or in a remote control of a lighting system. Furthermore, modern lighting systems often allow adjusting the saturation and, thus, may provide saturation selection means on a color selection input device. However, as described in the introductory part, the navigation through the hue and saturation color spectrum is inconvenient for most users if separate input means such as discrete buttons for hue and saturation are used.

FIG. 1 shows a color selection input device 10 according to an embodiment of the invention, which comprises a hue selection wheel 12 as hue selection means and a saturation selection wheel 14 as saturation selection means. Both wheels 12 and 14 may be implemented by wheels, which may be mechanically rotated clockwise and counter clockwise as indicated by the arrows. The hue selection wheel 12 comprises a visible scale representing the selectable hue gradation such that a user may directly see a selected hue. The saturation selection wheel 14 is transparent and shaded from fully transparent, i.e. fully saturated color, to fully white, i.e. unsaturated or white color. The transparency gradation of the saturation selection wheel 14 may be for example made by dots, printed on a transparent ring forming the wheel. The dots may have different colors and diameters depending on the transparency factor. Also, the density of the dots may influence the transparency. Typically, the dots may range from small density dots for little shading to high density dots for almost fully white.

Both wheels 12 and 14 are arranged such that they partly overlap or intersect, respectively, and, thus, comprise an overlapping area 16. In the overlapping area 16, the saturation selection wheel 14 is arranged over the hue selection wheel 12. Thus, the hue of the hue selection wheel 12, adjusted in the overlapping area 16, is covered by the gradation of saturation as selected in the saturation selection wheel 14. This visualizes a selected combination of hue and saturation for a user in a kind of result window, formed by the overlapping region 16. Depending on the adjustment of the saturation wheel 14, a high saturation may be obtained with the small density dots printed on the saturation selection wheel 14 and a low saturation with the high density dots, in the result windows, i.e. the overlapping area 16.

The adjustment of both wheels 12 and 14 is electronically detected by an electronic circuitry 18, which implements means for position detection and also signal generation means for generating a color control signal 19 for adjusting a lighting system, i.e. to adjust the selected hue and saturation. The electronic circuitry 18, for example an integrated circuit, is adapted to electronically detecting the position, i.e. the adjustment of both wheels, processing the detected adjustment with regard to the desired hue and saturation selection, generating the color control signal 19 for a lighting system depending on the processing and transmitting the generated control signal 19 to the lighting system.

Figure 2:
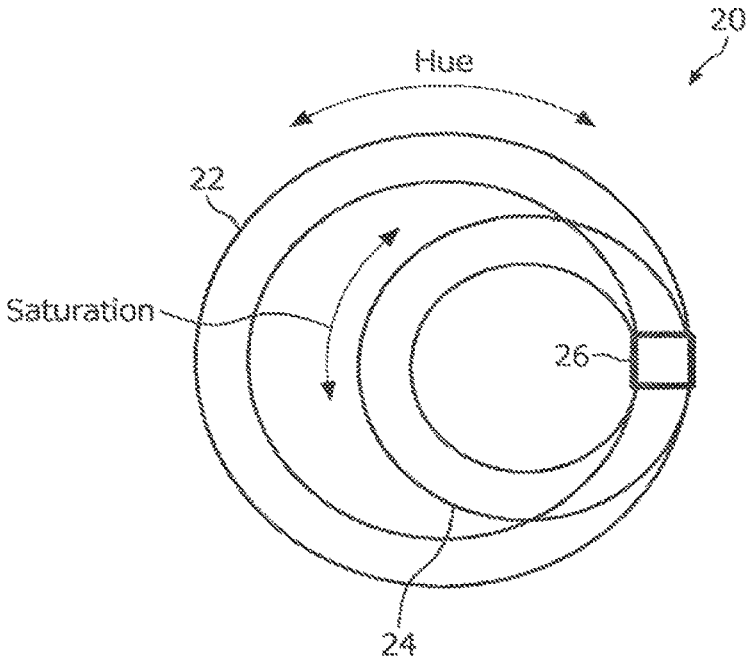
FIG. 2 shows a second embodiment of a color input device with a hue selection wheel and a saturation selection wheel according to the invention.

FIG. 2 shows another color selection input device 20 with a larger hue selection wheel 22 and a smaller saturation selection wheel 24, which is arranged within the hue selection wheel 22 such that it has a common, i.e. overlapping area 26 together with the hue selection wheel 22. Both wheels are mechanically rotating wheels in clockwise or counter clockwise directions as indicated by the arrows. Also in this embodiment, the hue selection wheel 22 comprises a visible scale representing the selectable hue gradation such that a user may directly see a selected hue. And the saturation selection wheel 24 is transparent and shaded from fully transparent, i.e. fully saturated color, to fully white, i.e. unsaturated or white color and arranged over the hue selection wheel 22, such that in the overlapping area 26 the user selected combination of hue and saturation is visible.

Figure 3:
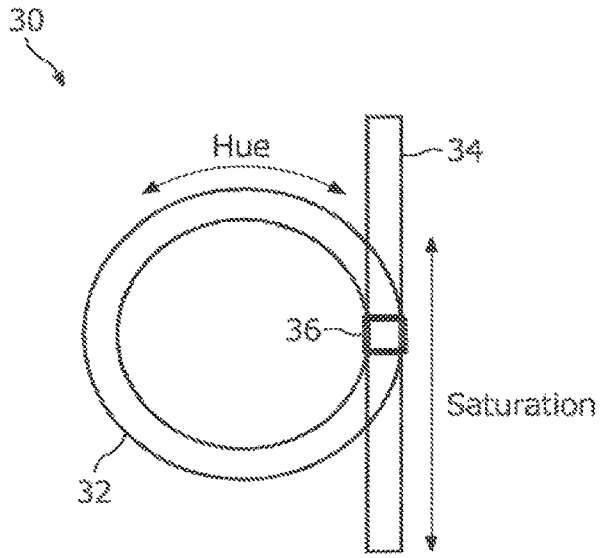
FIG. 3 shows a third embodiment of a color input device with a hue selection wheel and a saturation selection bar according to the invention.

Instead of a color selection wheel also a selection bar may be used. FIG. 3 shows a further embodiment of the color input selection device 30 according to the invention with a saturation selection bar 34, which partly overlaps in an overlapping area 36 with a hue selection wheel 32. The selection of a hue and saturation combination may be performed by rotating the mechanically rotating hue selection wheel 32 as indicated by the arrows to adjust a desired hue gradation in the overlapping area 36. A desired saturation may be selected by moving the saturation selection bar 34 in the directions as indicated by the arrows. The resulting combination of hue and saturation is visible in the overlapping area 36, since the saturation selection bar 34 is transparent and shaded from fully transparent, i.e. fully saturated, to fully white, i.e. fully unsaturated.

Figure 4:
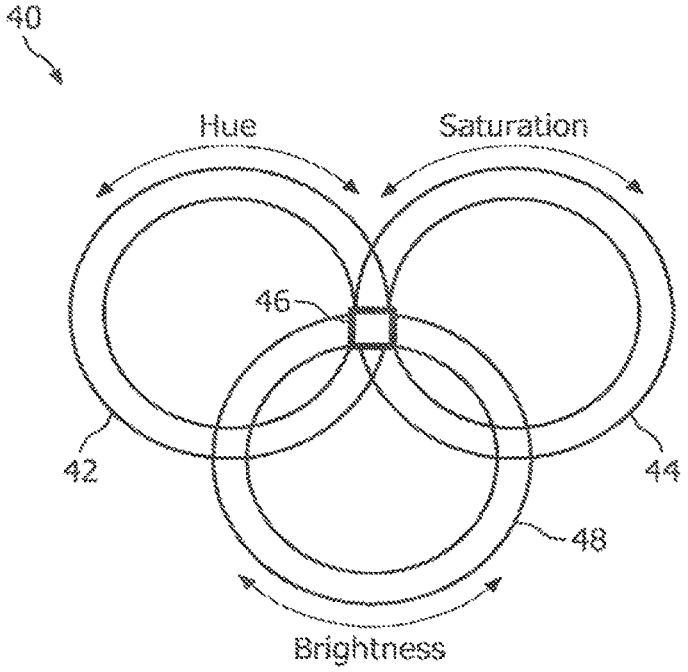
FIG. 4 shows a fourth embodiment of a color input device with a hue selection wheel, a saturation selection wheel, and a brightness selection wheel according to the invention.

In a further embodiment of the color input selection device 40 according the invention as shown in FIG. 4, also a brightness selection wheel 48 is provided for comfortably selecting a hue/saturation/brightness combination. This allows a user to comfortably navigating the hue/saturation/brightness color space by rotating the different wheels 42, 44, and 48 and watching the combination in the overlapping area 46, which is the intersection of all wheels 42, 44, and 48. In order to make the combination visible, the hue selection wheel 42 is arranged at the bottom of all wheels, while the saturation or brightness wheel 44 or 48, respectively, may be arranged on top, since both wheels are transparent and shaded from fully transparent, i.e. fully saturated and fully bright, to fully white and fully black respectively, i.e. fully unsaturated and fully dimmed respectively.

Figure 5:
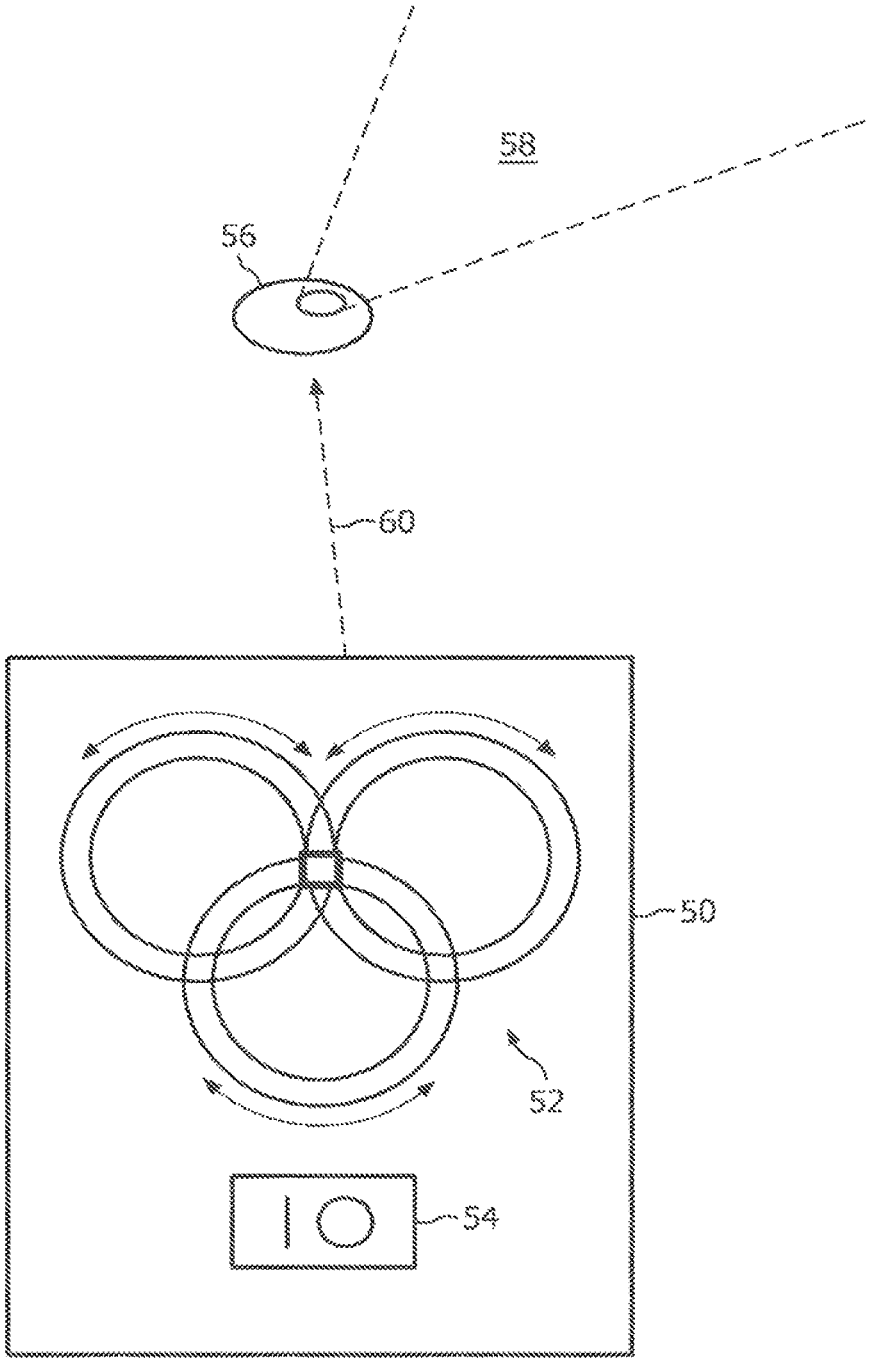
FIG. 5 shows an embodiment of a remote control for a lighting system with a color input device with a hue selection wheel, a saturation selection wheel, and a brightness selection wheel according to the invention.

FIG. 5 shows an embodiment of a remote control unit 50 for a lighting system 56 such as the LivingColors™ lamp of the applicant. The remote control unit 50 comprises a color selection input device 52 with three color wheel for hue, saturation and brightness as shown in FIG. 4. The lamp 56 may be switched on and off with the on/off switch 54 on the remote control unit 50. Each input on the remote control unit 50 is processed by an internal electronic circuitry (not shown) of the unit 50. As result of the processing, a control signal 60 for the lamp is generated and transmitted via a radio link to the lamp's 60 internal control circuitry, which then changes the generated lighting 58 in accordance with the received control signal 60, particularly adjusts the hue, saturation and brightness of the colored lighting 58 generated by the different color LEDs (Light Emitting Diodes) of the lamp 56.

The invention is particularly suitable for application in the field of color adjustment of a lighting system.

The invention has the main advantage that makes it more comfortable and intuitive for a user to navigate in the hue and saturation color space, particularly to select a preferred hue and saturation.

At least some of the functionality of the invention such as the functionality of the color selection processing means may be performed by hard- or software. In case of an implementation in software, a single or multiple standard microprocessors or microcontrollers may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. A color selection input device comprising:

a hue selection object representing selectable colors with hue gradation along a direction thereof;

a saturation selection object representing a selectable saturation gradation along a direction thereof;

wherein the hue selection object and the saturation selection object are arranged to form fixed overlapping region, and wherein the saturation selection object is transparent and shaded such that the saturation selection object varies from fully transparent to fully white in a plane by including portions of the saturation selection object in the plane that have different colors for visualizing a hue and saturation selection in the overlapping region; and an electronic circuit configured to detect positions of the hue selection object and the saturation selection object and to generate a color selection signal that depends on the detected positions, wherein the hue selection object and the saturation selection object are implemented by respective selection wheels, wherein one of the selection wheels has a smaller diameter than the other selection wheel and is arranged on the other selection wheel to form an overlapping area comprising the overlapping region.

2. The input device of claim 1, further comprising a brightness selection object representing a selectable brightness gradation along a direction thereof, wherein the brightness selection object is arranged such that the brightness selection object forms the overlapping region with the hue selection object and the saturation selection object, wherein the brightness selection object is transparent and shaded from fully transparent to fully black for visualizing a hue, saturation and brightness selection in the overlapping region.

3. The input device of claim 2, wherein the hue selection object and the saturation selection object are implemented by respective selection wheels, wherein both of said selection wheels form an overlapping area comprising the overlapping region.

4. The input device of claim 3, wherein the brightness selection object is implemented by an other selection wheel that is arranged such that the brightness selection object at least partly covers the overlapping region.

5. The input device of claim 2, wherein at least one of the hue selection object, the saturation selection object or the brightness selection object is implemented by a respective mechanical rotation wheel.

6. The input device of claim 2, wherein at least one of the saturation selection object or the brightness selection object is implemented by a respective mechanical selection bar.

7. The input device of claim 2, wherein at least one of the hue selection object, the saturation selection object or the brightness selection object is implemented on a touch screen display.

8. The input device of claim 1, wherein at least one of the hue selection object, the saturation selection object or the brightness selection object is implemented by a respective selection wheel.

9. The input device of claim 1, wherein the saturation selection object or the brightness selection object is implemented by a respective selection bar.

10. A color selection input method comprising: providing hue selection object representing selectable colors with hue gradation along a direction thereof, providing saturation selection object representing a selectable saturation gradation along a direction thereof, arranging the hue selection object and the saturation selection object such that the hue selection object and the saturation selection object comprise a fixed overlapping region, wherein the saturation selection object is transparent and shaded such that the saturation selection object varies from fully transparent to fully white in a plane by including portions of the saturation selection object in the plane that have different colors for visualizing a hue and saturation selection in the overlapping region, and detecting, by an electronic circuit, positions of the hue selection object and the saturation selection object and generating a color selection signal depending on the detected positions, wherein the hue selection object and the saturation selection object are implemented by respective selection wheels, wherein one of the selection wheels has a smaller diameter than the other selection wheel and is arranged on the other selection wheel to form an overlapping area comprising the overlapping region.

11. A non-transitory computer readable storage medium comprising a computer readable program for color selection input, wherein the computer readable program when executed on a computer causes the computer to perform the method of claim 10.

* * * * *